US010639561B2

(12) United States Patent
Moore et al.

(10) Patent No.: US 10,639,561 B2
(45) Date of Patent: May 5, 2020

(54) ARTICLE MOVEABLE BETWEEN TWO POSITIONS AND A METHOD OF COMBINING TWO OR MORE OF THE SAME

(71) Applicant: Boti Global Limited, Wan Chai (CN)

(72) Inventors: Steven Moore, London (GB); Brian Whitehead, London (GB); Tim Rowe, London (GB); Oliver Morris, London (GB)

(73) Assignee: BOTI GLOBAL LIMITED, Wan Chai (CN)

( * ) Notice: Subject to any disclaimer, the term of this patent is extended or adjusted under 35 U.S.C. 154(b) by 0 days.

(21) Appl. No.: 16/065,507

(22) PCT Filed: Dec. 22, 2016

(86) PCT No.: PCT/IB2016/001805
§ 371 (c)(1),
(2) Date: Jun. 22, 2018

(87) PCT Pub. No.: WO2017/109565
PCT Pub. Date: Jun. 29, 2017

(65) Prior Publication Data

US 2018/0369708 A1 Dec. 27, 2018

(30) Foreign Application Priority Data

Dec. 24, 2015 (GB) ..... 1522884.4

(51) Int. Cl.
*A63H 33/26* (2006.01)
*A63F 9/06* (2006.01)
*A63H 33/00* (2006.01)

(52) U.S. Cl.
CPC ..... *A63H 33/26* (2013.01); *A63F 9/06* (2013.01); *A63H 33/003* (2013.01); *A63F 2250/24* (2013.01)

(58) Field of Classification Search
CPC ..... A63H 33/003; A63H 33/26
(Continued)

(56) References Cited

U.S. PATENT DOCUMENTS 4,575,348 A * 3/1986 Wiggs ..... A63H 13/16 446/310
5,310,378 A * 5/1994 Shannon ..... A63H 33/004 446/268

(Continued)

FOREIGN PATENT DOCUMENTS

CN 2160443 Y 4/1994
CN 202724678 U 2/2013

*Primary Examiner* — Alexander R Niconovich
(74) *Attorney, Agent, or Firm* — Gable Gotwals

(57) ABSTRACT

There is provided an article being moveable between a first position and a second position and biased to the second position. The article is retained in the first position by retaining means until a predetermined condition is met, wherein when that predetermined condition is met, biasing means exert a biasing force to move the article from the first position to the second position. The predetermined condition is met when at least one formation, located on at least one face of the article, is moved from a first position to a second position, thereby releasing the retaining means and permitting movement of the article from the first position to the second position. Also provided is a group of at least two articles provided to interact with one another, with one article meeting the predetermined condition for moving the other from the first position to the second position.

16 Claims, 17 Drawing Sheets

(58) Field of Classification Search
USPC ..... 446/129, 130, 131, 132, 487, 71
See application file for complete search history.

(56) References Cited

U.S. PATENT DOCUMENTS

| | | | | |
|---|---|---|---|---|
| 7,306,504 | B2 * | 12/2007 | Saucier | A63H 3/003 446/268 |
| 7,458,874 | B2 * | 12/2008 | Rung | A63H 13/00 446/330 |
| 7,785,168 | B2 * | 8/2010 | Yamada | A63H 33/003 446/376 |
| 7,988,014 | B2 * | 8/2011 | Jan | B65D 43/021 215/301 |
| 8,066,542 | B2 * | 11/2011 | Ejima | A63H 33/003 446/376 |
| 8,500,508 | B2 * | 8/2013 | Yamada | A63H 33/003 446/130 |
| 8,814,629 | B2 * | 8/2014 | Johnston | A63H 33/003 273/359 |
| 8,974,264 | B2 * | 3/2015 | McCafferty | A63H 17/008 124/10 |
| 9,573,072 | B2 * | 2/2017 | Cai | A63H 17/264 |
| 2003/0176146 | A1 * | 9/2003 | Norman | A63H 3/18 446/310 |
| 2009/0053969 | A1 * | 2/2009 | Hui | A63H 13/00 446/130 |
| 2012/0032395 | A1 * | 2/2012 | Levine | A63F 3/00157 273/238 |
| 2019/0099684 | A1 * | 4/2019 | Fernandez | A63H 33/003 |
| 2019/0224582 | A1 * | 7/2019 | Fernandez | A63H 11/00 |

* cited by examiner

ARTICLE MOVEABLE BETWEEN TWO POSITIONS AND A METHOD OF COMBINING TWO OR MORE OF THE SAME

CROSS-REFERENCE TO RELATED APPLICATIONS

This application is the United States National Phase of Patent Application Ser. No. PCT/IB2016/001805 filed 22 Dec. 2016, which claims priority to British Patent Application No. 1522884.4 filed 24 Dec. 2015, each of which are incorporated herein by reference.

BACKGROUND OF THE INVENTION

The invention to which this application relates is an article or articles moveable between a first and second position when a predetermined condition is met. The invention further relates to a method of bringing two of said articles together in a predefined manner.

Although the following description refers exclusively to the use of such articles as play toys and a method of playing with two or more of the same, the person skilled in the art will appreciate that the present invention could also be used for various other purposes not limited to games.

Collectable toys have been known for some time. In particular, collectable "battling" toys are also known and have been provided in many different forms, for example, the range of battling collectables sold under the trade name Beyblade™ involve propelling two spinning collectable items into a battle arena, the collectable items subsequently making contact with one another as their spinning paths coincide. The winner is the one which remains spinning in the arena having either knocked the other off of its spinning axis or out of the arena entirely. Various techniques may be used by the user when introducing the collectable item to the arena, in order to provide their collectable item with an advantage against the opposing collectable item.

Another form of collectable battling toy, sold under the trade name Bakugan™ involves toys that can transform from a first condition into a second condition prior to or during battle. Determination of the winner can be decided by a set of specific playing cards which can indicate what moves may be played or health points etc. may be gained. Again, as the battle/game progresses, users/players will have an indication of who may emerge as the eventual winner. However, neither of these sets of "battling" collectables provides a scenario where the final winner will remain unknown until the eventual outcome is known, with little or no indication prior to the outcome.

In the Applicant's co-pending international patent application WO2015/159077, there is disclosed an article which is provided and initially retained in a first position, but is biased to a second position. When brought into contact with or within a predetermined range of a second article, a predetermined condition is met within one of the articles, and one of the two will be "activated" to move to the second position. In the scenarios disclosed in the Applicant's co-pending application, the predetermined condition is met when a first magnet on the first article is activated by a second magnet on the second article, which, in turn, triggers a release catch, allowing the first article to move to the second position. The mechanism by which the articles are activated relies on the specific arrangement and interaction of the magnets in the interacting articles. However, over time, magnets may lose their sensitivity or attractiveness as a result of the articles being dropped, jolted etc., and consequently the functionality of the articles is reduced.

It is therefore an aim of the present invention to provide an article that overcomes the aforementioned problems.

It is a further aim of the present invention to provide a combination of two or more articles that overcomes the aforementioned problems.

It is yet a further aim of the present invention to provide a method of combining two or more articles that overcomes the aforementioned problems.

According to a first aspect of the invention there is provided an article, said article being moveable between a first position and a second position and biased to the second position, said article being retained in the first position by retaining means until a predetermined condition is met, wherein when said predetermined condition is met biasing means exert a biasing force to move the article from the first position to the second position, characterised in that said predetermined condition is met when at least one formation, located on at least one face of the article, is moved from a first position to a second position, thereby releasing said retaining means and permitting movement of the article from the first position to the second position.

In one embodiment, said at least one formation is formed to extend outwardly from at least one face of the article. Typically, said at least one formation is provided to be urged substantially inwardly of the article, thereby releasing said retaining means.

In one embodiment, said at least one formation is one of a plurality of formations which may be moved from first to second positions, typically, by being urged inwardly of the article. Typically, only one of the formations, when urged inwardly of the article, is capable of release of the retaining means and the movement of at least some of the formations has no impact on the retaining means.

In one embodiment, at least one formation, located on the article, is provided as a substantially rigid formation, such that it cannot be urged inwardly of the article.

In one embodiment, the article includes at least one formation which may be urged inwardly of the article and at least one formation provided as a substantially rigid formation, such that it cannot be urged inwardly of the article.

In one embodiment, the article includes one formation which may be urged inwardly of the article to release the retaining means, at least one further formation which may be urged inwardly of the article, and at least one formation provided as a substantially rigid formation, such that it cannot be urged inwardly of the article.

In one embodiment the said predetermined condition is created by a second article which may in one embodiment, be similar to the first article, being brought into contact with, or being positioned within a predetermined range of, the said first article.

Thus, the present invention provides an article, which is retained in a first position until a predetermined condition is met, at which point it moves to a second position. The provision of a plurality of formations on a face of the article which may be depressed inwardly of the article, whereby only one of the formations, when depressed, releases retaining means, means that a user may not necessarily know which of the formations can release the retaining means upon depression. A substantially rigid formation may also be provided on the article, such that the article may be brought into contact with a second article and the rigid formation serves to urges formations located on that article inwardly—whether or not the depressed formation releases retaining means associated with that article is dependent upon the particular configuration of the plurality of formations associated with the article.

In one embodiment, the at least one formation and said retaining means are associated substantially with one face of the article. Typically, the at least one formation and said retaining means are associated substantially with the same face of the article. Further typically, said retaining means connects the face with which it is associated to an adjacent face, thereby retaining the article in the first position.

In one embodiment, the retaining means are provided in the form of a catch. Typically, said catch is releasable when said at least one formation is urged inwardly of the article by a predetermined distance. Preferably, where a plurality of formations is provided, said catch is releasable when one formation of the plurality of formations is urged inwardly of the article by a predetermined distance.

In one embodiment, faces of the article are hinged. Typically, said retaining means retains adjacent free edges of two faces, thereby retaining the article in the first position. Further typically, the article is retained in the first position by the retaining means against the action of the biasing force.

In one embodiment, a removable body is provided associated with at least one face of the article. Typically, said at least one formation is located with the removable body. Further typically, a plurality of formations is located with the removable body. In one embodiment, the retaining means is located with the removable body.

In one embodiment, said body is removably attached to one of the said faces of the article. Typically, said body is removably located within an aperture in one of the said faces of the article. Further typically, said body may be removably located with a second or further article. Thus, one or more removable bodies are interchangeable with one or more articles. Differing removable bodies will have differing configurations, resulting in a different formation on the body being responsible for releasing the retaining means when depressed.

In one embodiment, said removable body is located with the article such that it is located substantially within an interior of the article when the article is in the first position. Typically, the removable body, when located with the article, forms at least part of the face of article in which it is located.

In one embodiment, said second position is an inverted form of the article with respect to said first position. Typically, when said predetermined condition is met, the article moves from said first position to the second, inverted position.

In one embodiment, the article forms a polyhedron composed of four or more faces and/or panels. Typically, the article forms a tetrahedron, pentahedron, cube, octahedron, dodecahedron, or icosahedron shape and/or the like. Further typically, the faces and/or panels of the polyhedron are biased to the second position.

In one embodiment, the article is composed of six faces. Typically, said six faces connect to form faces of a substantially cube-shaped article. Further typically, said faces are biased to the second position.

In one embodiment, said biasing means are provided in the form of one or more springs. Typically, said one or more springs are provided as any or any combination of coil springs, leaf springs, torsion springs, hair springs and/or the like.

In one embodiment, biasing means are provided at or substantially at an interface between two adjacent faces of the article. Typically, said biasing means are connected to the two adjacent faces, biasing said faces to the second position.

In one embodiment, at least one magnet is provided associated with the article. Typically, said at least one magnet is located on a face of the article. Preferably, said at least one magnet is located on the same face of the article with which the at least one formation is associated. In one embodiment, two magnets are provided, located on the said face of the article.

In one embodiment, said at least one magnet is located directly on a face of the article. Typically, said at least one magnet is located adjacent an aperture in which a removable body is locatable, the removable body including said at least one formation. Preferably, two magnets are provided on opposing sides of the aperture in which the removable body is locatable.

In one embodiment, said at least one magnet is provided to align the article substantially with a second article. Preferably, two magnets are provided on substantially opposing sides of the same face of the article, so as to align the article with corresponding magnets located on a second article. Thus, magnets are provided on the article which serves purely as a directional force for the article when aligning the same with a second article with which it may interact. This permits interaction of the active faces of the respective articles, allowing the predetermined condition to be met for one of the articles when they are brought into contact or within a predetermined proximity of one another. When the predetermined condition is subsequently met for one of the articles, the retaining means of that article is released and the article is permitted to move from the first position to the second position.

In one embodiment, the article further includes reset means. Typically, said reset means are provided to aid a user in moving the article from the second position to the first position. Thus, the reset means are provided so as to aid a user in moving the article back from an inverted position to which it has been biased upon release of the retaining means, back to the original first position.

In one embodiment, said reset means include one or more string or thread members and/or the like. Typically, said one or more string or thread members are provided to connect two or more faces or panels provided on the article.

In one embodiment, upon activation by a user, said reset means are provided to at least partially return the article to the first position from the second position. Typically, remaining parts of the article which have not been returned to the first position, can be returned to said position by a user after use of said reset means.

In one embodiment, where the article comprises a plurality of faces and/or panels, the reset means are arranged to return at least two of said faces and/or panels to the first position.

In one embodiment, where the reset means is provided as one or more string or thread members or the like, said string or thread member is arranged to be pulled or tugged by a user, and such action serves to aid in bringing the article to the first position. Thus, the provision of a reset means, typically, in the form of one or more string or thread members, enables a user to move the article back to the initial first position with greater ease than if they had to work the article without such a mechanism. In typical embodiments where the article may comprise a plurality of faces and/or panels, all biased to the second position, it can be rather fiddly or tricky to restore the article to the first position, and so providing a reset means that can restore at least some of the said faces and/or panels to the first position, makes it far easier for the user to move the remaining faces/panels, and hence the whole article, back to the first position.

In one embodiment, the article may be provided to be presented in the form of an animal or character or such like, when in the second position. Typically, reset means provided with the article may be provided to form a particular feature or body part of the animal/character of the article, when in the second position.

In one embodiment, a plurality of attachable members is provided associated with the panels and/or faces of the article. Typically, said attachable members are provided on the said faces and/or panels so as to be visible when the article is in the second position. Further typically, said attachable members are provided to be removable and/or interchangeable with other such members. Yet further typically, said attachable members are provided to form or appear as features or body parts of an animal or character represented by the article, when in the second position.

In one embodiment, the article comprises a plurality of evenly sized panels and/or faces. Typically, at least one panel/face is provided of a smaller size than the other panels/faces. In one embodiment, said smaller panel/face has a further panel or portion hingedly attached thereto. Typically, said further panel or portion is provided of a size equal to or less than the said smaller panel/face. Further typically, when the article is in the first position, said further panel/portion is located substantially on the interior of the article.

In a further aspect of the present invention, there is provided a group of articles including at least two articles movable between first and second positions and biased to the second positions, said articles retained in their respective first positions by retaining means until a predetermined condition is met, wherein said predetermined condition is met for at least one of the articles when the articles are brought into contact or within a predefined distance, at which point said one of the at least two articles moves from the first position to the second position under the influence of biasing means, characterised in that said predetermined condition is met when at least one formation, located on at least one face of said one of the at least two articles, is moved from a first position to a second position, thereby releasing said retaining means and permitting movement of the said article from the first position to the second position.

In one embodiment, said at least one formation is formed to extend outwardly from at least one face of the said one of the at least two articles. Typically, said at least one formation is provided to be urged substantially inwardly of that article, thereby releasing said retaining means.

Typically, said at least one formation is arranged to be urged substantially inwardly upon contact with a corresponding formation on the second of the at least two articles. Preferably, the corresponding formation, located on the said second article, is provided as a substantially rigid formation, such that it cannot be urged inwardly of the article on which it is located, but is arranged to urge the first formation on the first article inwardly, such that the predetermined condition is met for the first article.

In one embodiment, each article includes at least one formation which may be urged inwardly of the article and at least one formation provided as a substantially rigid formation, such that it cannot be urged inwardly of the article. Preferably, each article includes a plurality of formations which may be moved from first to second positions, typically, by being urged inwardly of the article. Typically, only one of the formations, when urged inwardly of the article, releases the retaining means.

In one embodiment, said second position is an inverted form of the at least two articles with respect to said first position. Typically, when said predetermined condition is met in one of the articles, the article moves from said first position to the second, inverted position.

In one embodiment, said second position, when the predetermined condition is met in a first of the at least two articles, is for the first article to move, typically inverting, and at least partially engulfing, enclosing and/or entrapping a second of said at least two articles.

In one embodiment, biasing means are provided on each of the at least two articles. Typically, said biasing means bias the at least two articles to their respective second positions. Further typically, upon release of retaining means on a first of the at least two articles, said first article moves from the first position to the second position.

In one embodiment, at least first and second formations are located on or associated with, each of the at least two articles. Typically, the first formation on or associated with, a first article corresponds to a second, substantially rigid formation on or associated with, a second article. Further typically, when the first formation on or associated with, the first article contacts the second substantially rigid formation on or associated with, the second article, the first formation is urged inwardly of the first article and the predetermined condition is met for the first article. Thus, the first article is now moveable from the first position to the second position. Yet further typically, the movement of the first article from the first position to the second position involves the first article at least partially engulfing, enclosing and/or entrapping the second article.

In one embodiment, the first formation on or associated with, the second article corresponds to a second, substantially rigid formation on or associated with, a third article. Typically, the second, substantially rigid formation on or associated with the first article corresponds to a first formation on or associated with the third or a further article.

In one embodiment, a removable body is provided associated with at least one face of each of the articles. Typically, said formations are located with the removable body. In one embodiment, retaining means are located with each of the removable bodies. Typically, each retaining means is provided to retain the article with which it is associated in the first position, until the predetermined condition is met for that article.

In one embodiment, said body is removably attached to one of the said faces of the article. Typically, said body is removably located within an aperture in one of the said faces of the article. Further typically, said body may be removably located with a second or further article. Thus, one or more removable bodies are interchangeable between the articles. Typically, a plurality of bodies are provided, which are removably attachable to each of said articles. Differing removable bodies will have differing configurations, resulting in a different formation on the body being responsible for releasing the retaining means when depressed.

In one embodiment, said removable body is located with the article such that it is located substantially within an interior of the article when the article is in the first position. Typically, the removable body, when located with the article, forms at least part of the face of article in which it is located.

In one embodiment, at least one magnet is provided associated with each article. Typically, said at least one magnet is located on a face of the articles. Preferably, said at least one magnet is located on or associated with the same face of the articles with which the formations are associated. In one embodiment, two magnets are provided, located on the said face of the articles.

In one embodiment, said at least one magnet is located directly on a face of each of the articles. Typically, said at least one magnet is located adjacent an aperture in which a removable body is locatable, the removable body including said formations. Preferably, two magnets are provided on opposing sides of the aperture in which the removable body is locatable.

In one embodiment, said at least one magnet is arranged to align two articles with one another. Preferably, two magnets are provided on substantially opposing sides of the same face of the article, so as to align the first article with corresponding magnets located on the second article.

In one embodiment, the articles further include reset means. Typically, said reset means are provided to aid a user in moving the articles from the second position to the first position. Thus, the reset means are provided so as to aid a user in moving the article back from an inverted position to which it has been biased upon release of the retaining means, back to the original first position.

In one embodiment, said reset means include one or more string or thread members and/or the like. Typically, said one or more string or thread members are provided to connect two or more faces or panels provided on the articles.

In one embodiment, upon activation by a user, said reset means are provided to at least partially return an article to the first position from the second position. Typically, remaining parts of the article which have not been returned to the first position, can be returned to said position by a user after use of said reset means.

In one embodiment, where the articles comprise a plurality of faces and/or panels, the reset means are arranged to return at least two of said faces and/or panels to the first position.

In another aspect of the present invention, there is provided a method of causing interaction between at least two articles, said method comprising the steps of: providing at least two articles in respective first positions and moveable between said first position and respective second positions; moving the at least two articles towards each other until a predetermined condition for either or both of the first and/or second articles is met and wherein once said predetermined condition is met in an article, biasing means exert a biasing force to move that article from the first position to the second position, characterised in that said predetermined condition is met when at least one formation, located on at least one face of that article, is moved from a first position to a second position, by a corresponding formation on the other article, thereby releasing said retaining means and permitting movement of that article from the first position to the second position.

In one embodiment, said at least one formation extends outwardly from at least one face of that article, and is urged substantially inwardly of the article by a corresponding formation on the other article, thereby releasing said retaining means.

Typically, when said predetermined condition is met in one of the articles, that article moves from said first position to the second, inverted position.

In one embodiment, said second position, when the predetermined condition is met in a first of the at least two articles, is for the first article to move, typically inverting, and at least partially engulfing, enclosing and/or entrapping the second of said at least two articles.

In one embodiment, a removable body is provided associated with at least one face of each of the articles. Typically, said formations are located with the removable body. In one embodiment, retaining means are located with each of the removable bodies. Typically, each retaining means is provided to retain the article with which it is associated in the first position, until the predetermined condition is met for that article.

In one embodiment, said body is removably attached to one of the said faces of the article. Typically, said body is removably located within an aperture in one of the said faces of the article. Further typically, said body may be removably located with a second or further article. Thus, one or more removable bodies are interchangeable between the articles. Typically, a plurality of bodies are provided, which are removably attachable to each of said articles. Differing removable bodies will have differing configurations, resulting in a different formation on the body being responsible for releasing the retaining means when depressed.

In one embodiment, said removable bodies are interchangeable between articles and a first user chooses a first body to be located with a first article and a second user chooses a second body to be located with a second article.

Each user selects a particular removable body for attachment to their respective article, and consequently, the configurations of the formations therein will determine which of the said articles is activated when two are brought into contact with one another.

Embodiments of the present invention will now be described with reference to the accompanying figures, wherein:

FIGS. 1*a-d* illustrate the opening stages of an article in accordance with an embodiment of the present invention;

Figure 4A:
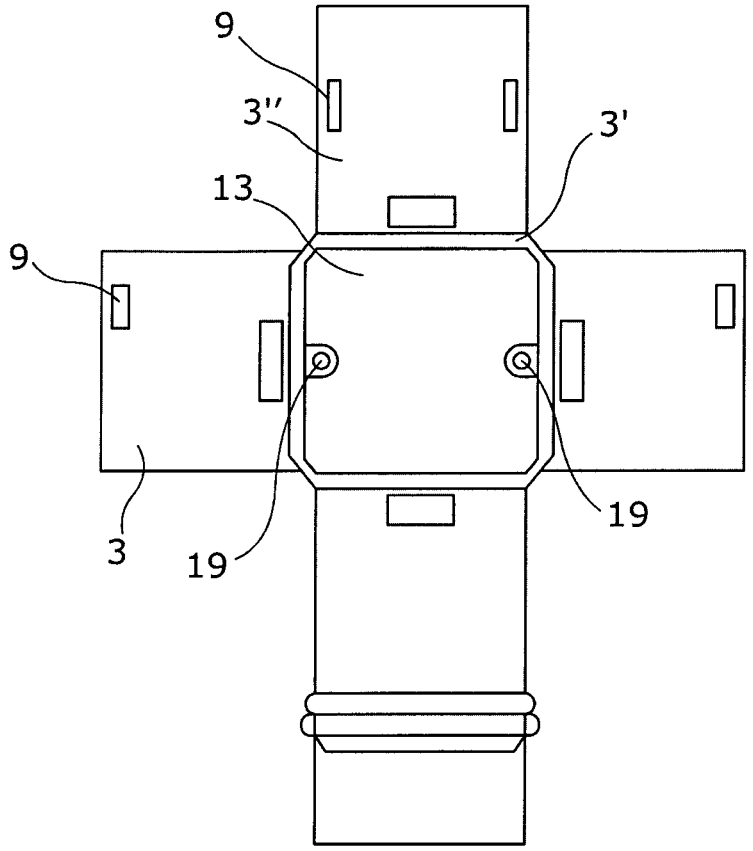
Figure 4B:
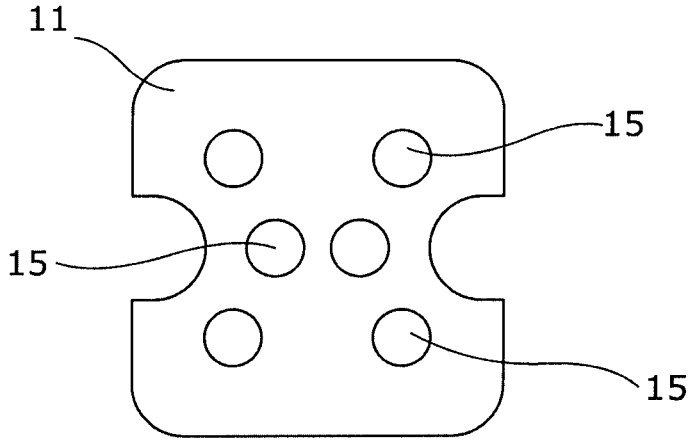
Figure 7B:
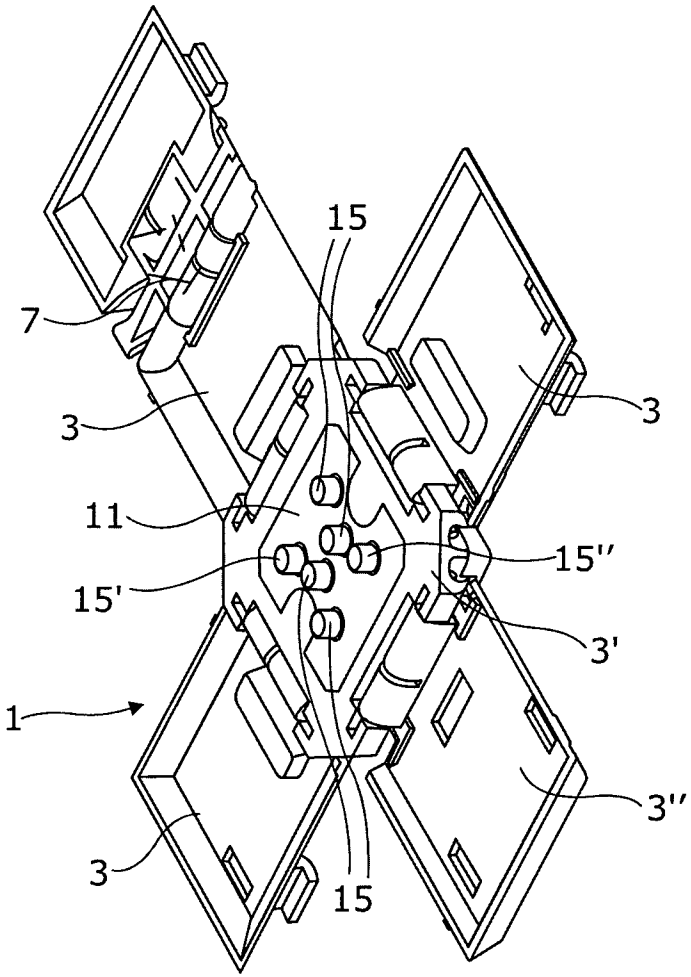
Figure 7A:
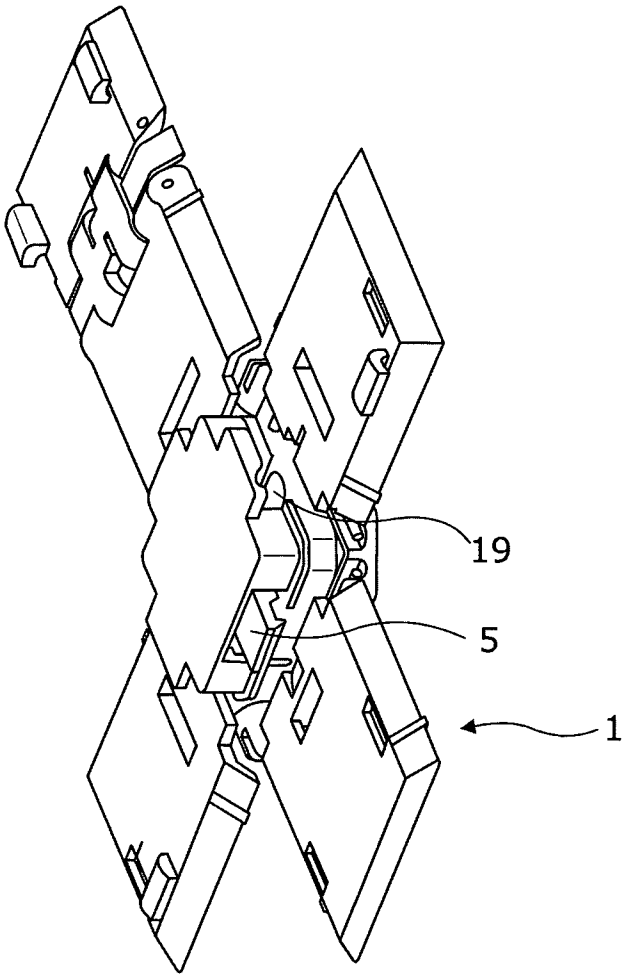
Figure 7D:
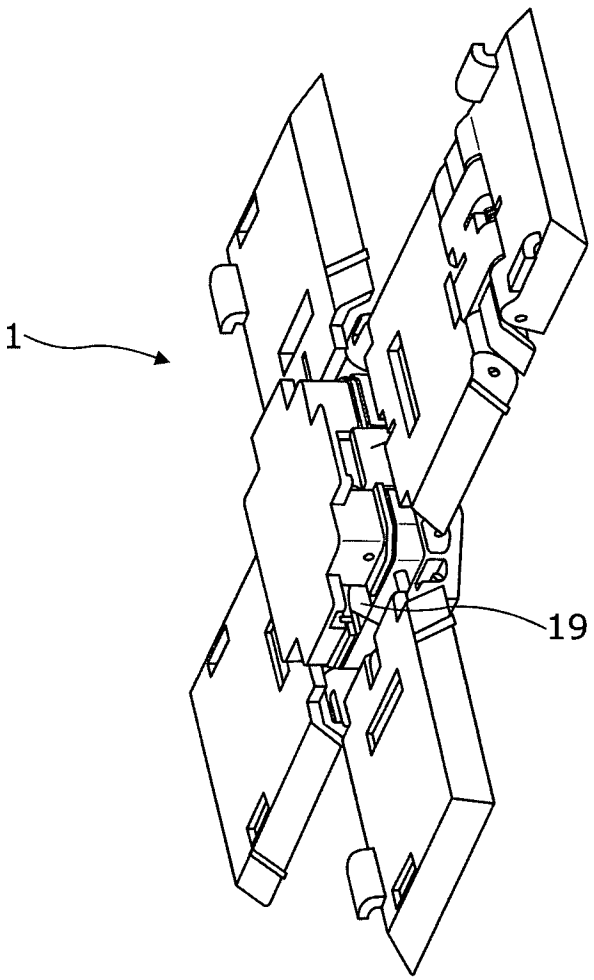
Figure 7C:
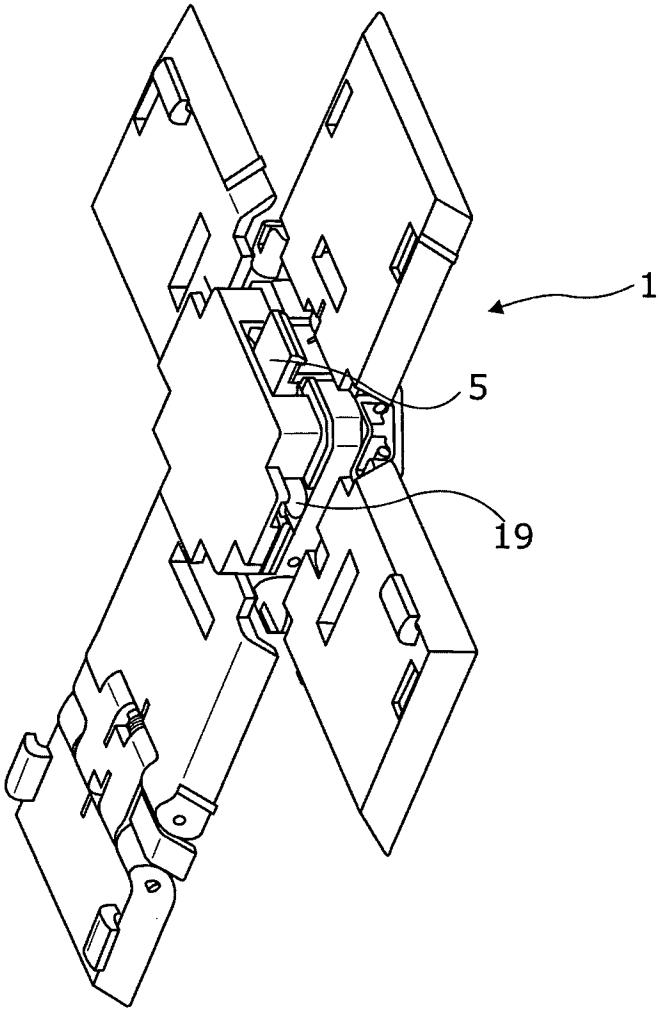
Figure 7F:
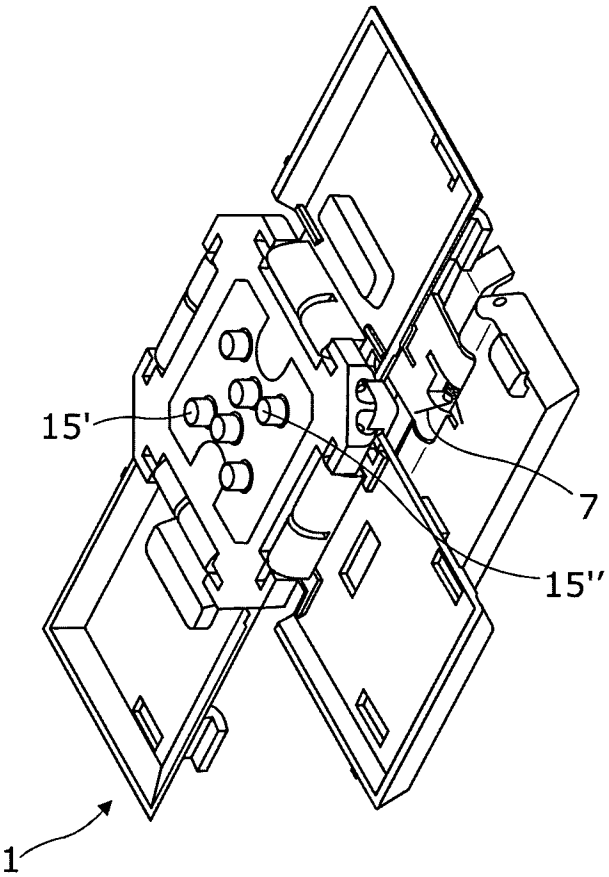
Figure 7E:
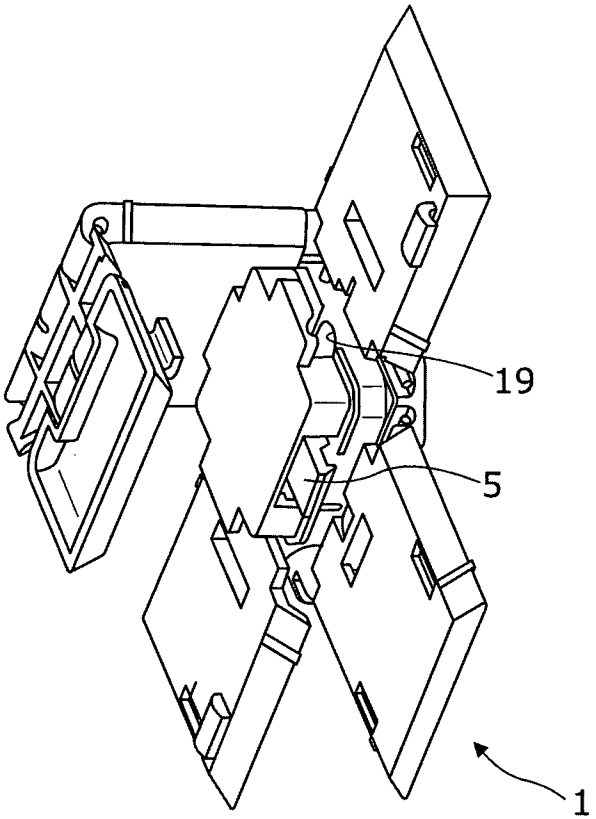
Figure 7H:
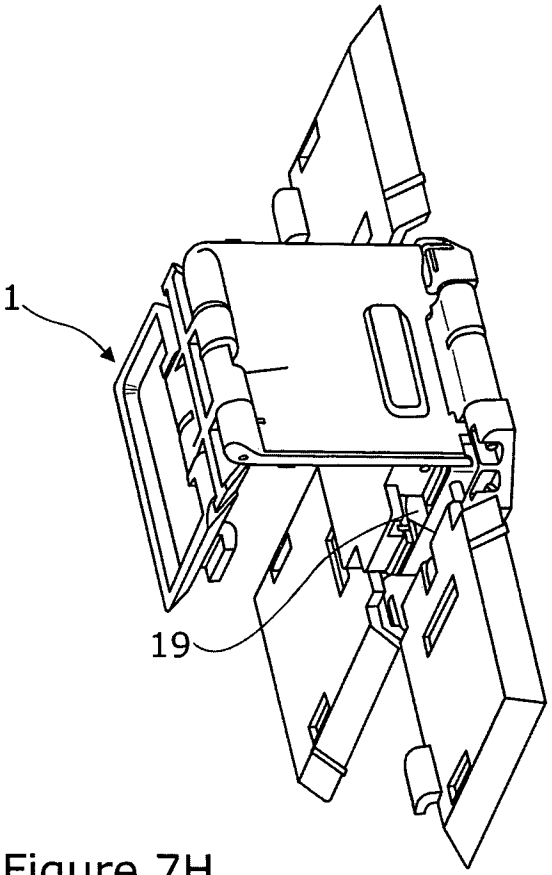
Figure 7G:
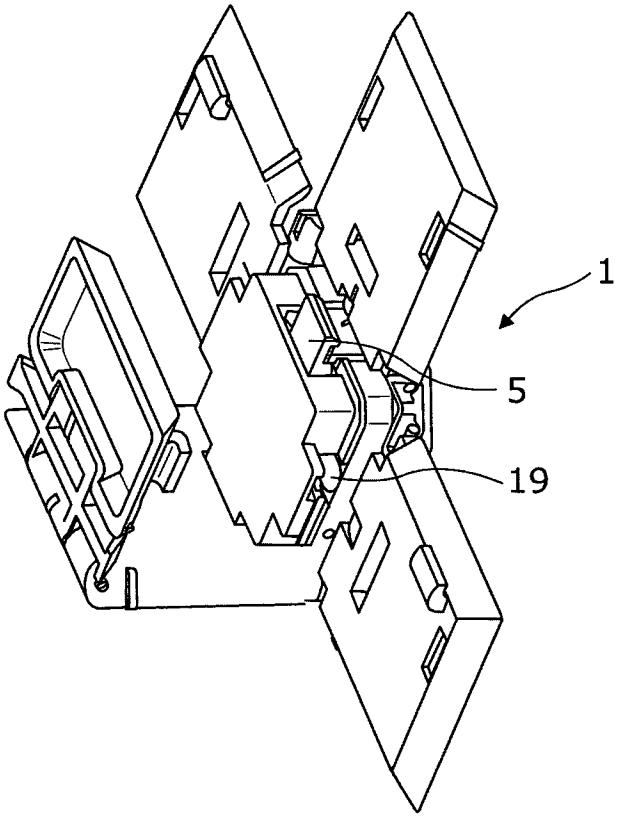
Figure 7J:
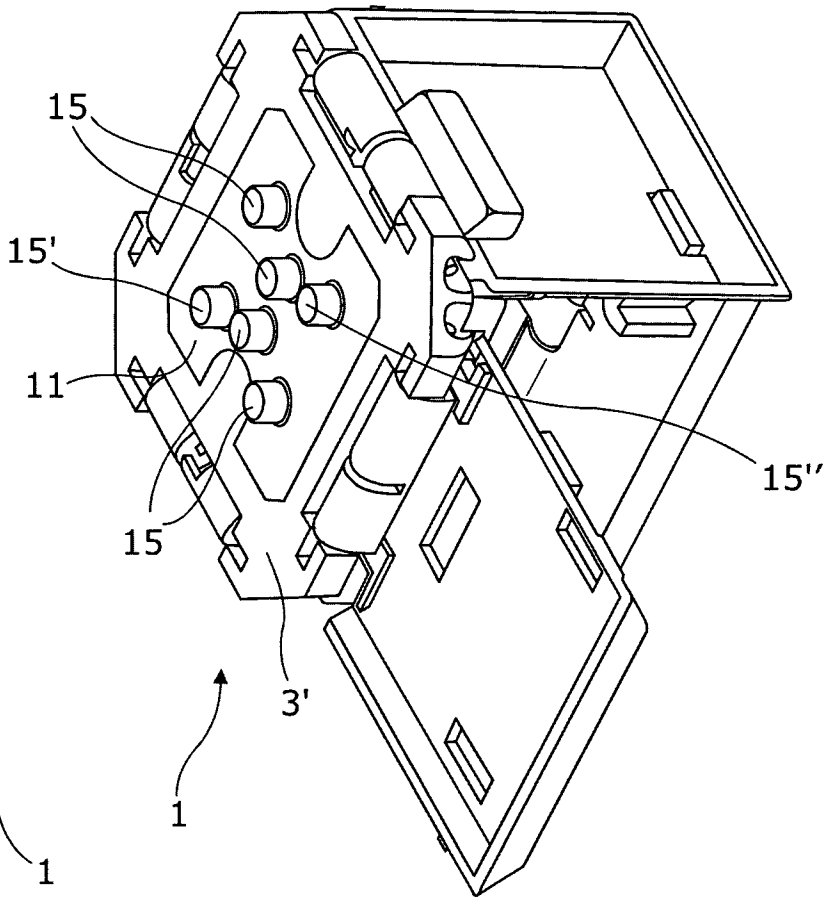
Figure 7I:
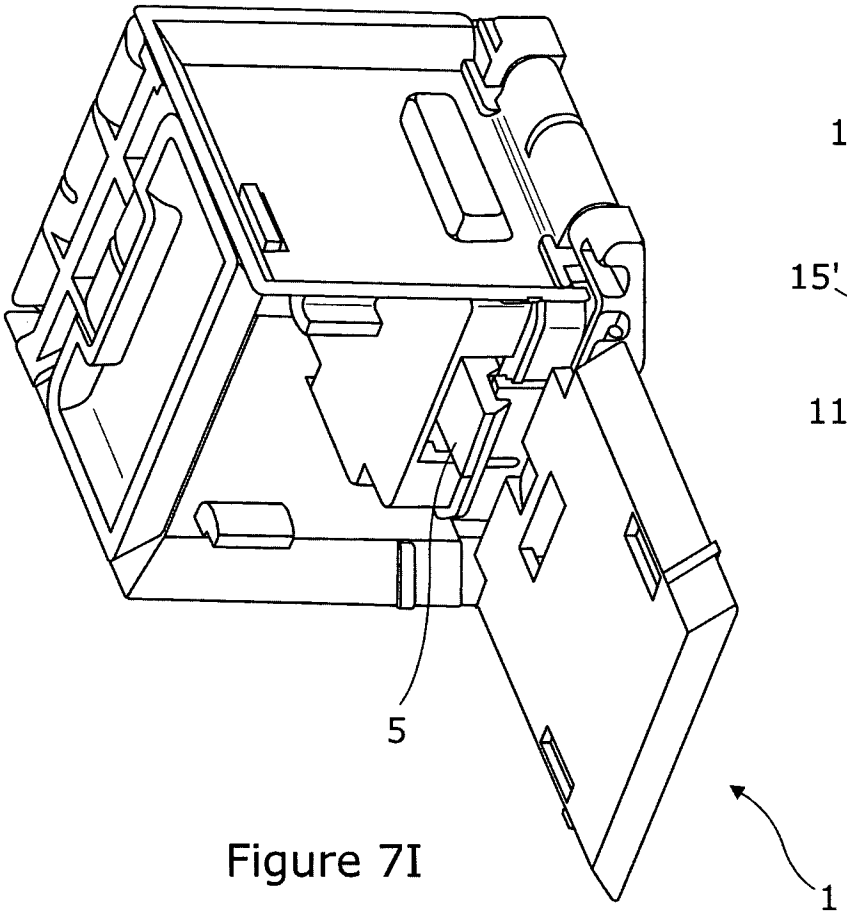
Figure 7L:
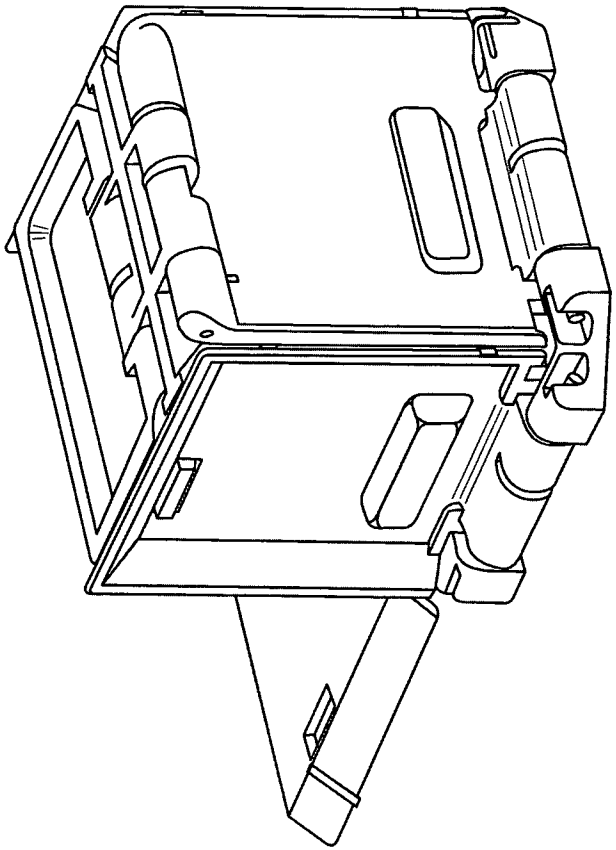
Figure 7K:
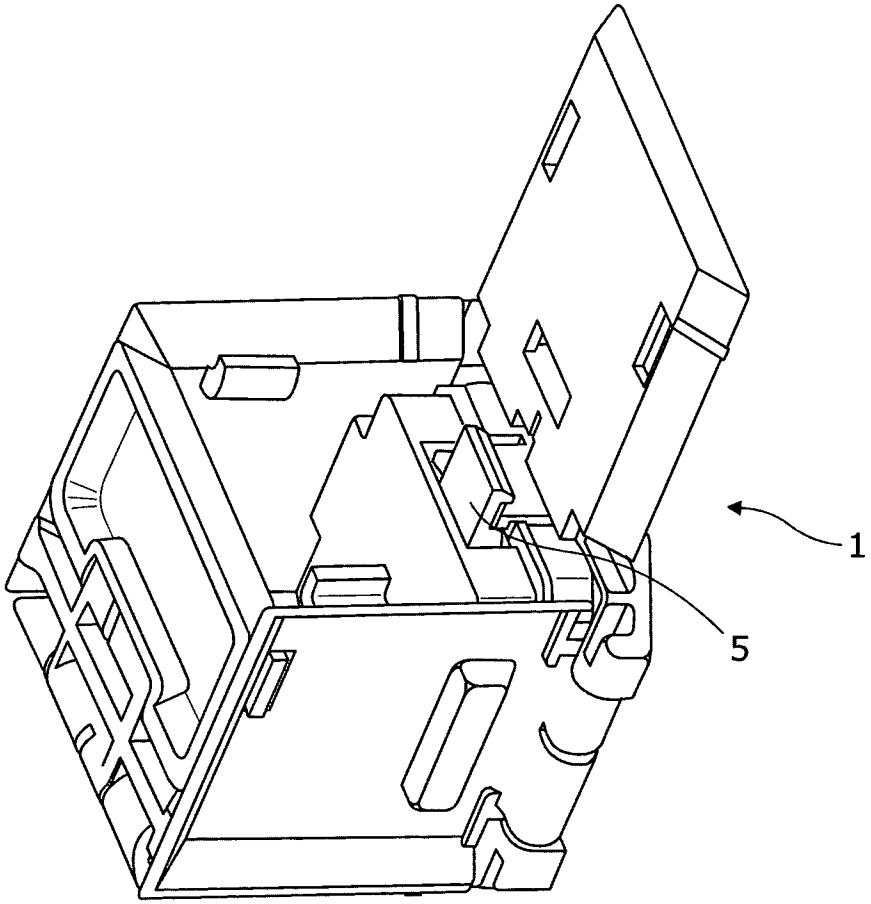
Figure 7N:
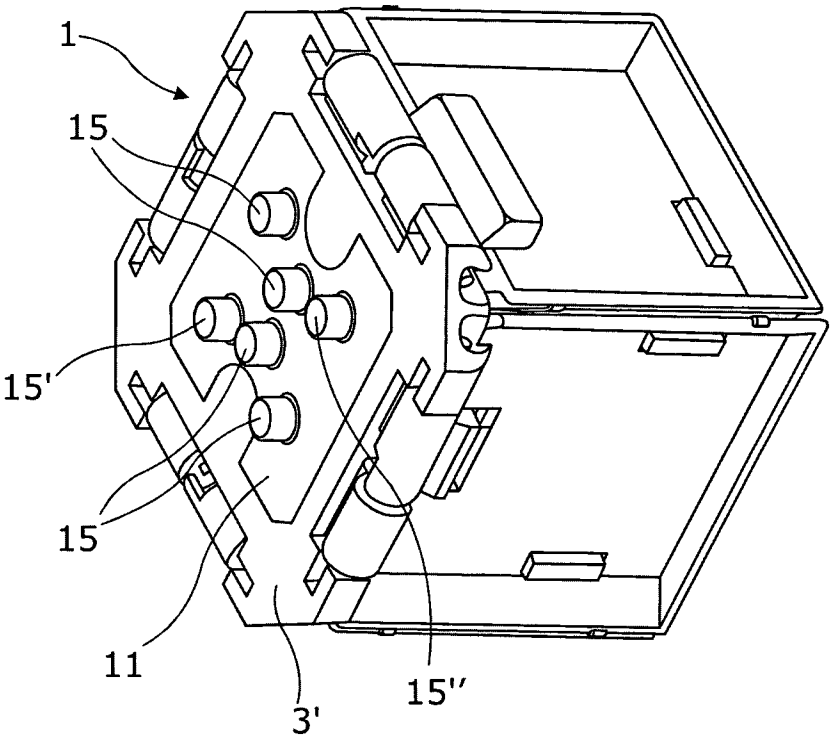
Figure 7M:
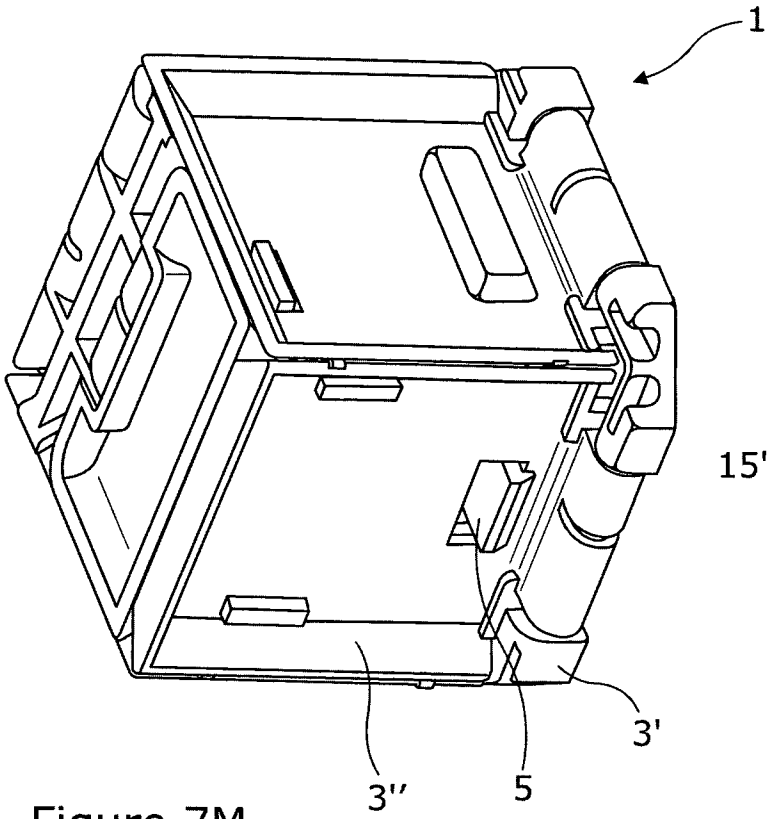
Figure 7P:
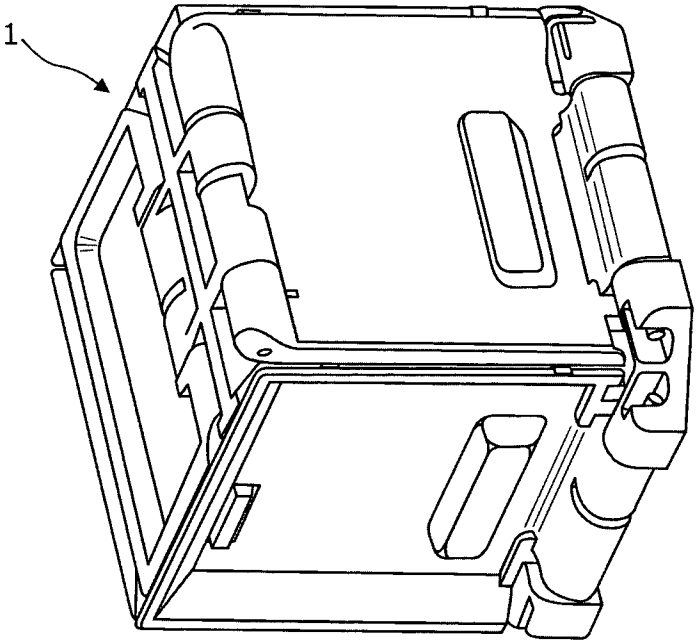
Figure 7O:
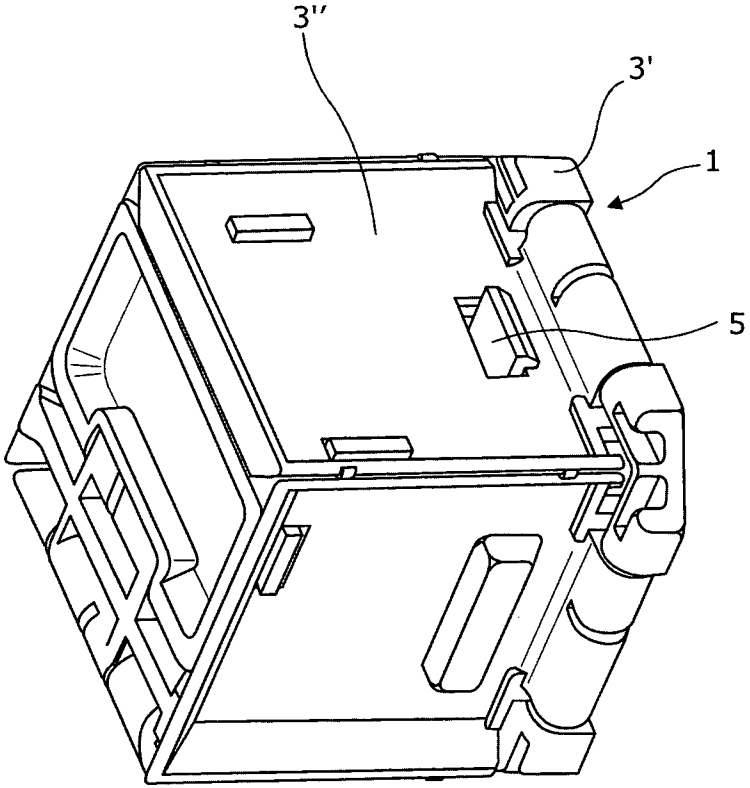
Figure 8B:
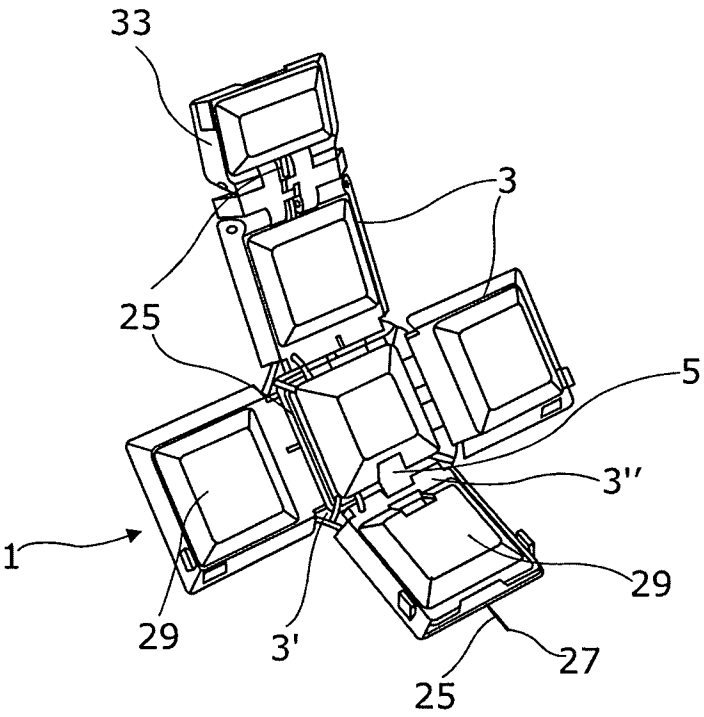
Figure 8A:
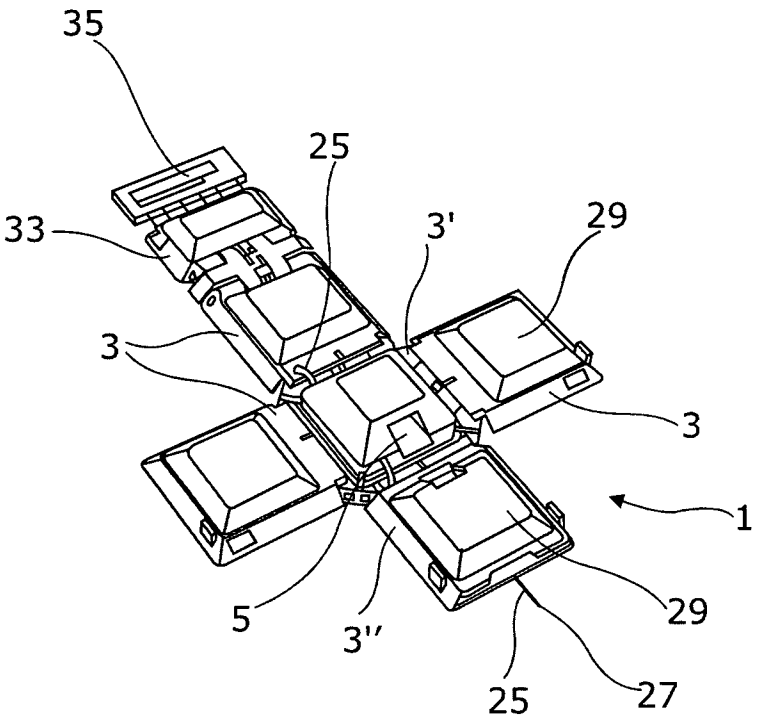
Figure 8D:
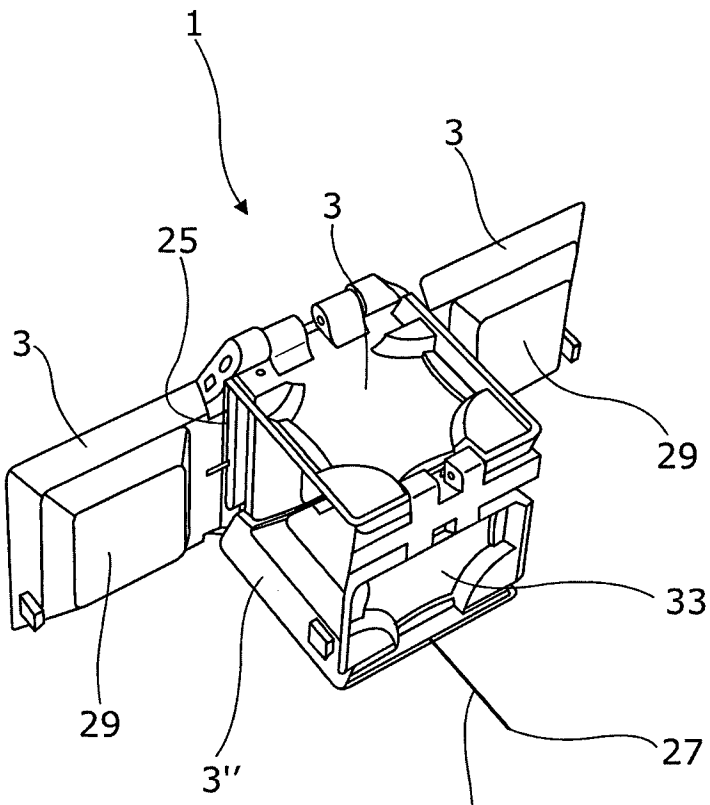
Figure 8C:
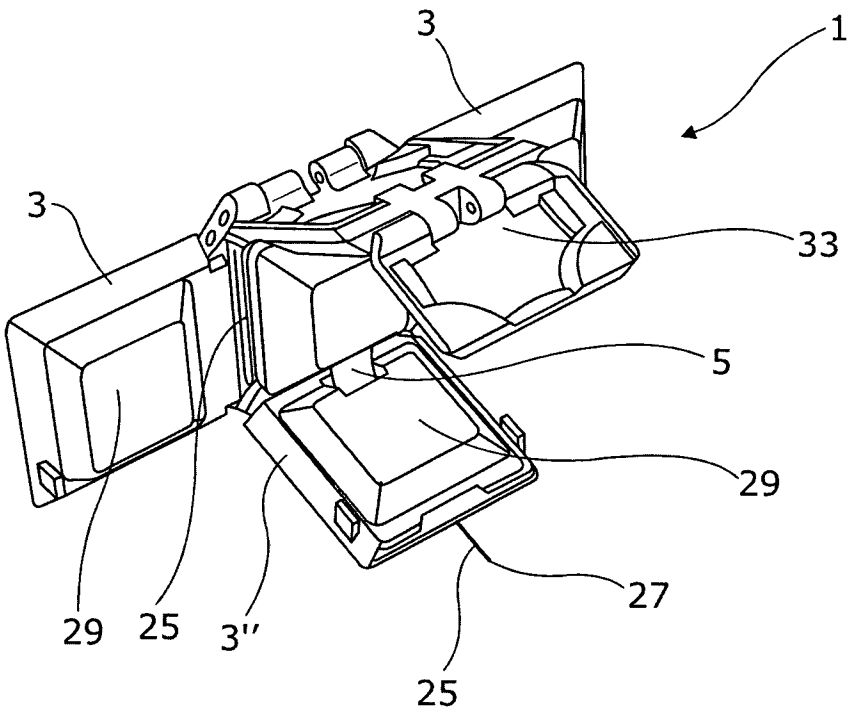

FIGS. 4*a-b* illustrate views of an opened-out article and a removable body for the article, in accordance with an embodiment of the present invention;

FIGS. 5*a-h* illustrate various views of a panel of an article and an associated removable boy, in accordance with an embodiment of the present invention;

FIGS. 6*a-h* illustrate various views of an article with a removable body, in accordance with an embodiment of the present invention; and FIGS. 7*a-p* illustrate various views of the stages of closing an opened-out article to a first position, in accordance with an embodiment of the present invention.

FIGS. 8*a-d* illustrate various stages of an article with reset means, in accordance with an embodiment of the present invention.

Figure 1A:
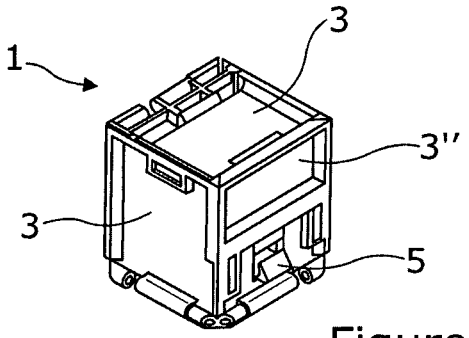
Figure 1B:
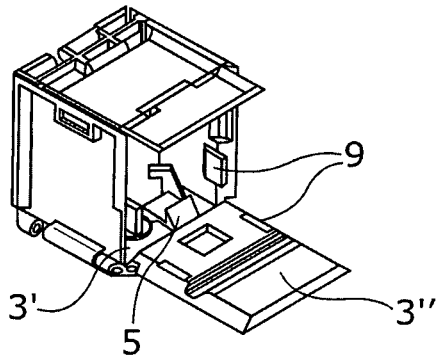
Figure 1C:
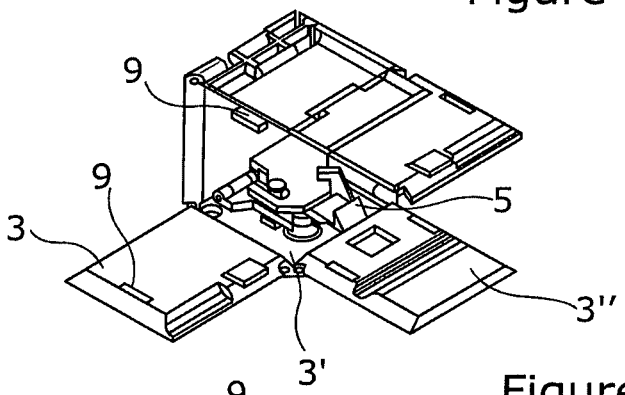
Figure 1D:
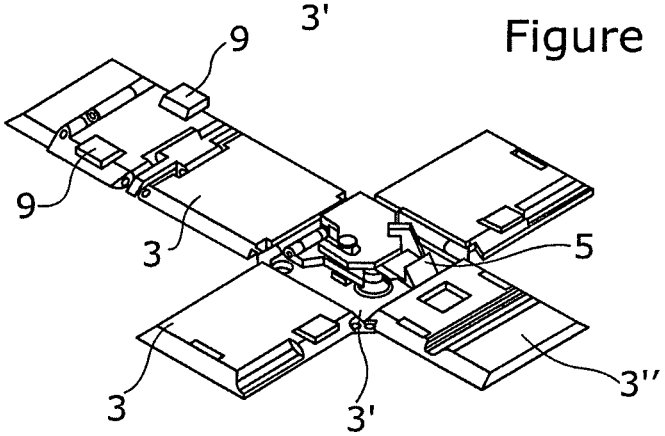

Referring firstly to FIGS. 1*a-d*, there is provided an article in the form of a substantially cube-shaped playing collectable item or toy (1). The toy (1) can be moved from a first position, shown in FIG. 1*a*, and a second position, wherein the toy (1) is completely inverted with respect to its first position. FIGS. 1*a-d* illustrate the opening stages of the toy (1) from the first position in FIG. 1*a* to an intermediate position between the first and second positions in FIG. 1*d*, shown more clearly in FIG. 2. In this particular embodiment, the toy (1) is provided in a cube shape and is composed of six connected panels (3). The panels (3) are biased, via biasing means, to move to the second position but are retained in the first position until a predetermined condition is met. When the predetermined condition is met, the toy (1)

moves from the first position to the second position. A release catch (5) is located on one of the panels (3') and, when the toy (1) is in the first position, the catch (5) engages an adjacent panel (3"), retaining it and the remaining panels (3) in the first position. The panels (3, 3', 3") of the toy (1) are hinged and the release catch (5) retains adjacent edges of two panels (3', 3") in position, thereby retaining the toy (1) in the first position. The toy (1) is retained in the first position by the release catch (5) against the action of a biasing force until such point that it is released.

Figure 3:
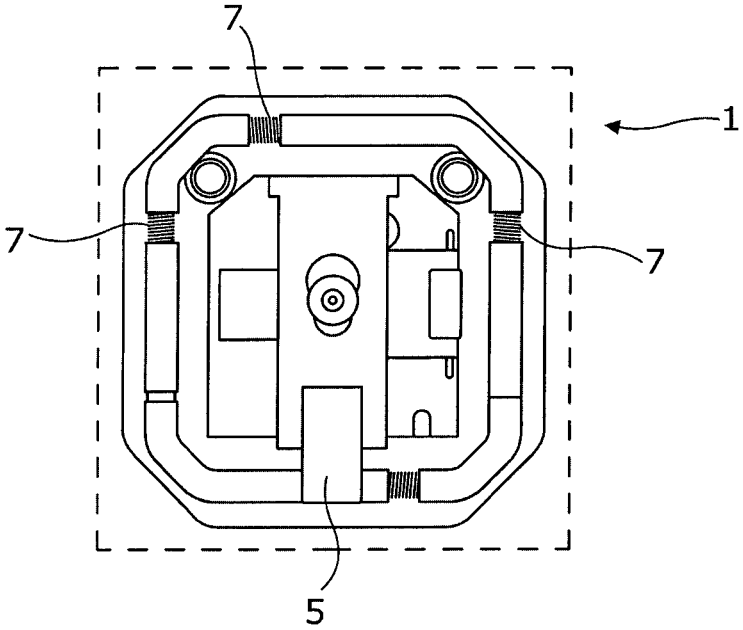
FIG. 3 illustrates a view of retaining means and biasing means on an article in accordance with an embodiment of the present invention.

Biasing means in the form of springs (7) are provided to bias the toy (1) to the second position. The springs (7) are best illustrated in FIG. 3. The springs (7) may be provided in various forms such as any or any combination of coil springs, leaf springs, torsion springs, hair springs and/or the like. In this particular embodiment, the springs (7) are provided as coiled torsion springs. The springs (7) are located at the edge of a panel (3), connecting the panel (3) on which it is located with an adjacent panel (3). The series of springs (7) that are provided on the panels (3) bias the toy (1) to the second, inverted position. This biasing movement is only allowed, however, upon release of the catch (5) from the adjacent panel (3") to which it connects. When the catch (5) is released from the adjacent panel (3"), that panel (3") opens outwardly due to the biasing force of the springs (7), shown in FIG. 1*b*. The remaining panels (3), which had previously been held in place in the first position by panel (3") and a series of secondary catches (9), subsequently open outwardly, as shown in FIGS. 1*c* and *d* until the toy (1) is in an inverted, second position.

Figure 2:
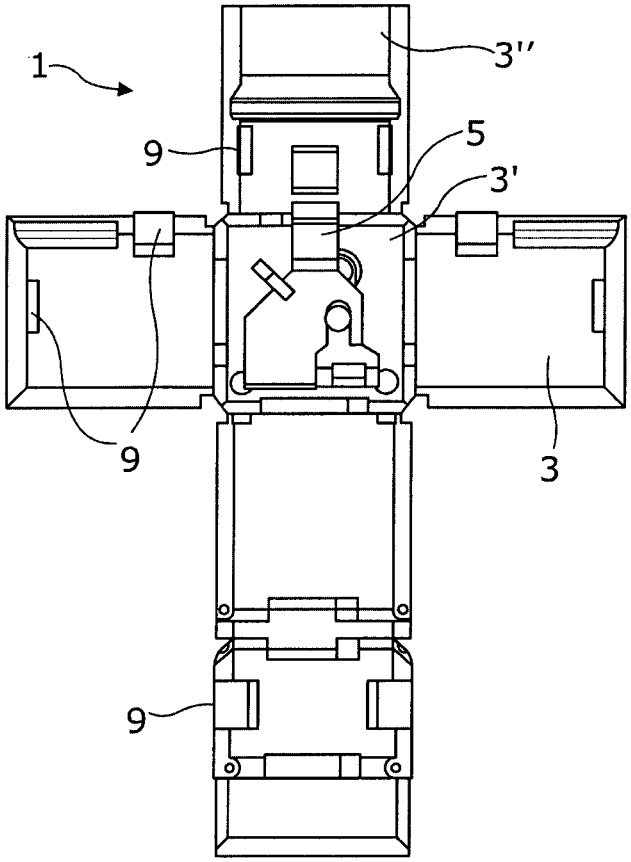
FIG. 2 illustrates a plan view of an opened-out article in accordance with an embodiment of the present invention.
Figure 5A:
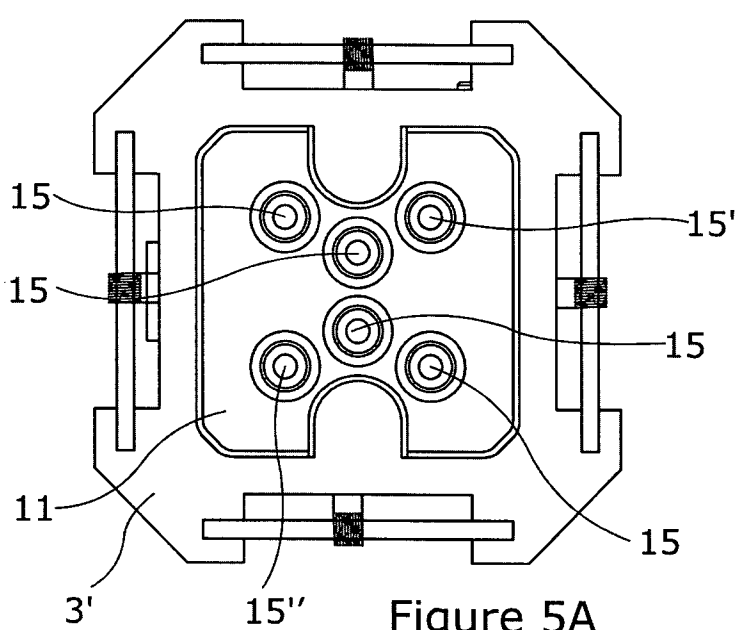
Figure 5B:
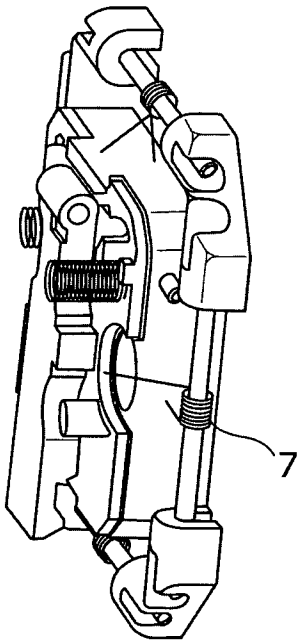
Figure 5C:
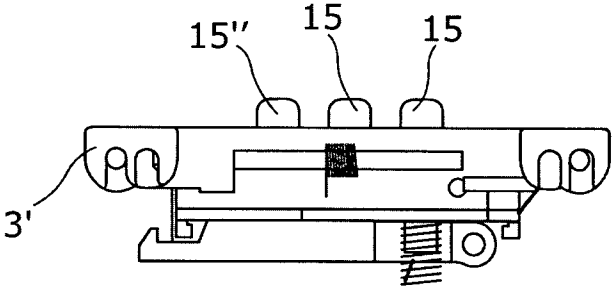
Figure 5D:
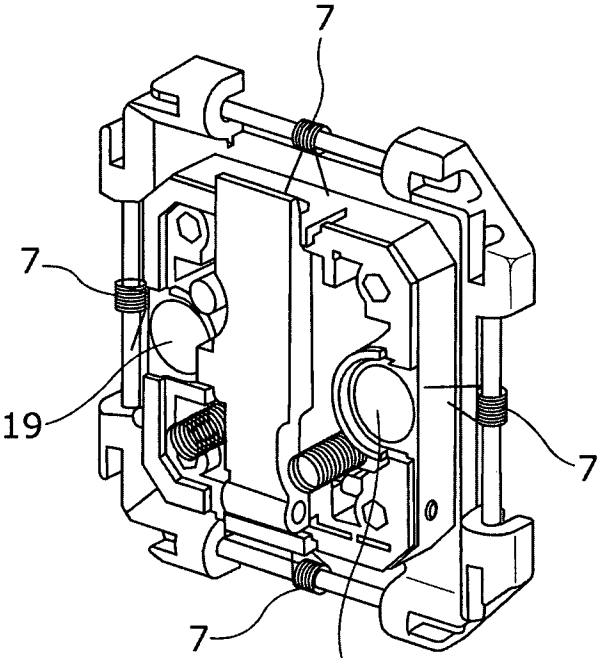
Figure 5H:
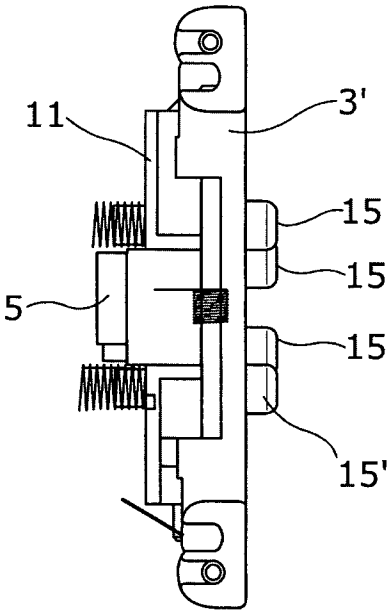
Figure 5E:
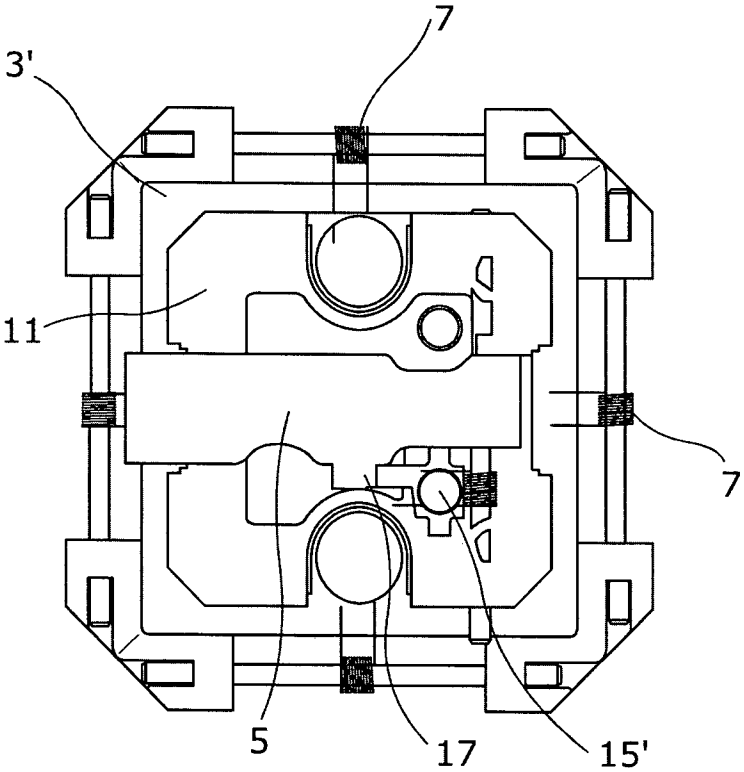
Figure 5G:
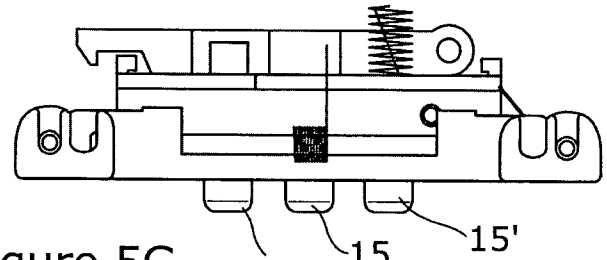
Figure 5F:
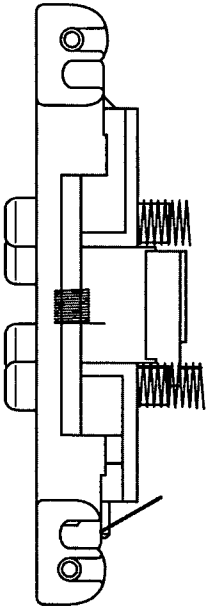
Figure 6A:
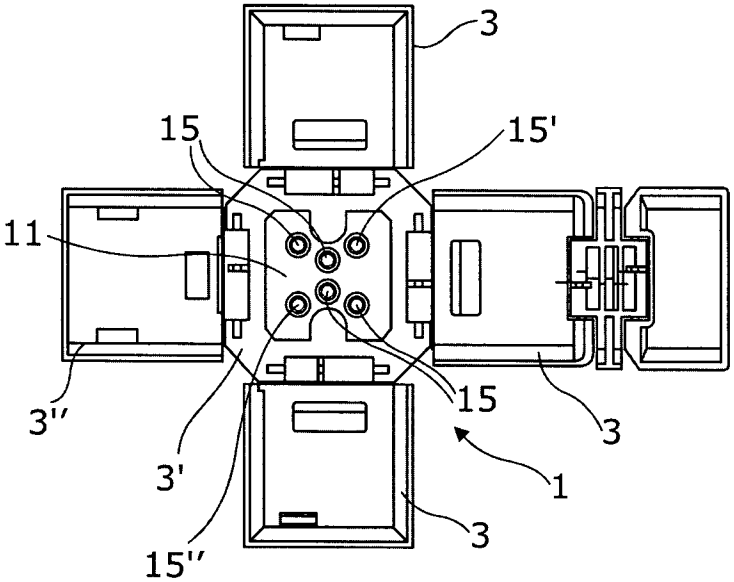
Figure 6C:
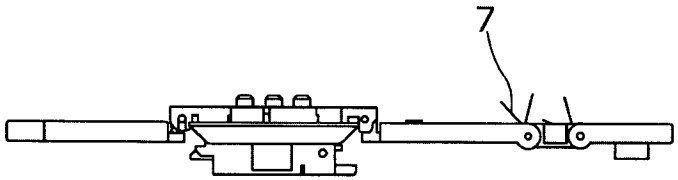
Figure 6D:
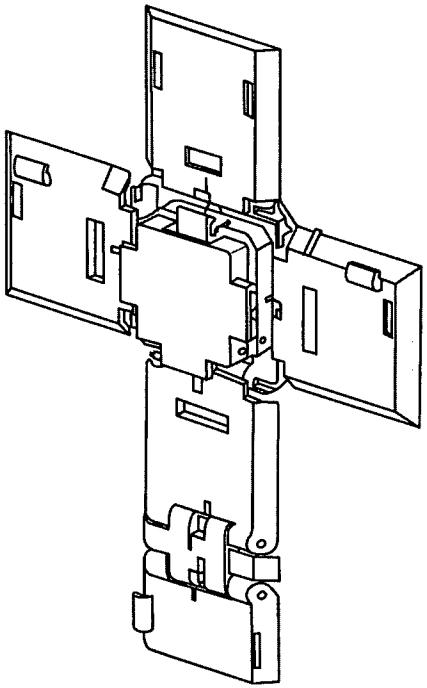
Figure 6B:
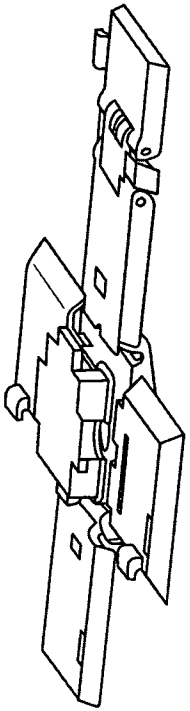
Figure 6H:
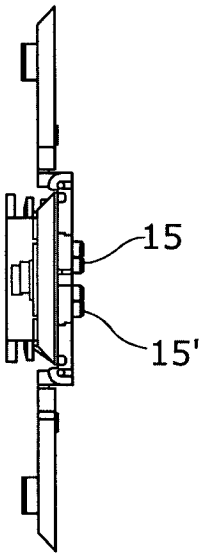
Figure 6E:
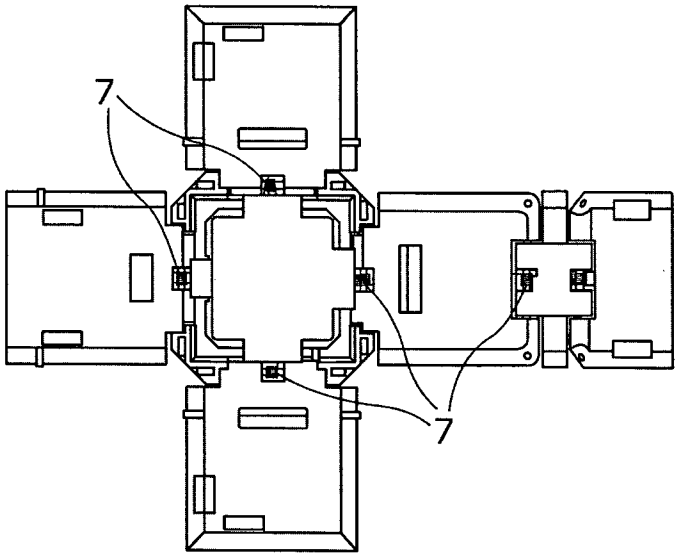
Figure 6G:
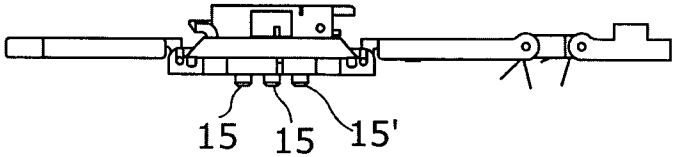
Figure 6F:
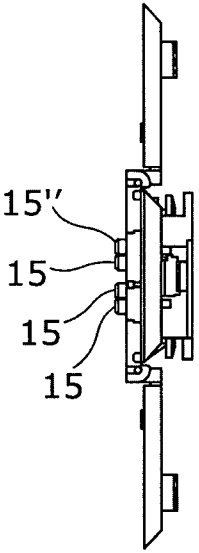

FIGS. 1-3 illustrate a toy article (1) wherein the catch (5) and release mechanism in general are located on a panel (3') of the toy (1). In preferred embodiments of the present invention, the catch (5) and release mechanism are located on a removable body (11), which can be inserted into and removed from an appropriately-sized aperture (13) in panel (3'), as shown in FIGS. 4*a-b*. FIGS. 5*a-h* illustrate various views of the panel (3') with the removable boy (11) located therein, with the release catch (5) and mechanism located on the rear of the body (11), such that it will be located in the interior of the toy article (1) when it is in the first position. FIGS. 6*a-h* illustrate the combined panel (3') and body (11) as part of the fully opened up toy article (1). As can be seen from FIGS. 4-6, while the release catch (5) and mechanism is located on the rear of the body (11), the front face of the body (11), which fills the aperture (13) and completes the face of the panel (3') includes a plurality of formations, or protrusions (15), which extend outwardly from the face of the panel (3')/body (11). The present embodiments illustrate toy articles (1) having six of these protrusions, however, it will be understood that the function of the toy (1) will work with as few as two protrusions (15); the upper limit being set by whatever the manufacturer deems to be desired and/or practicable. At least one of the protrusions (15') is depressible, such that it may be urged inwardly of the toy (1)/body (11), and as it does so, the predetermined condition, as mentioned above, is met, releasing the catch (5) via the connection point (17) as shown in FIG. 5*e*. Once the catch (5) is released from a locked position, releasing adjacent panel (3") therefrom, the biasing springs (7) bias the toy (1) to move from the first position to the second, inverted position.

Whilst only one formation/protrusion (15') is required to release the catch (5) when depressed, that protrusion is one of several, in this embodiment six, protrusions (15) located on the body (11). Several of these protrusions (15) are also depressible inwardly of the body (11)/toy (1), however, only one (15') is provided so as to activate/release the catch (5). One of the protrusions (15") is provided such that it is substantially rigid relative to the body (11)/toy (1) and cannot be urged inwardly. The depressing of the protrusions (15) and, hence, the releasing of the catch (5) is affected when the panel (3') of the toy (1) is moved into contact with a corresponding panel (3') on a second toy (1). Thus, the present invention provides a toy article (1), which is retained in a first position until a predetermined condition is met, at which point it moves to a second position. The provision of a plurality of protrusions (15) on a panel (3') of the toy (1), or on a removable body (11) which may be inserted into an aperture (13) located within the panel (3'), which may be depressed inwardly of the toy (1), whereby only one of the protrusions (15'), when depressed, releases retaining means, ensures that a user may not necessarily know which Protrusions (15) releases the retaining means upon depression. A substantially rigid protrusion (15"), relative to the toy (1)/body (11) is also provided on the toy (1), such that the toy (1) may be brought into contact with a second toy and the rigid protrusion (15") serves to urges protrusions located on that toy inwardly—whether or not the depressed protrusion releases a retaining catch associated with that toy is dependent upon the particular configuration of the protrusions associated with the toy. It should also be understood that while the present description the protrusions (15), catch (5) and mechanism as being located on the removable body (11), which is inserted into the aperture (13) of panel (3'), it will be appreciated that in other forms of the invention, the protrusions (15), catch (5) and mechanism can be located directly into the face of the panel (3') and designed not to be removable.

The toy (1) is also provided with one or more magnets (19) attached thereto. In the described embodiments, two magnets (19) are provided integral with the panel (3') of the toy (1) in which the removable body (11) may be located. As can be seen most clearly in FIGS. 4-5, the magnets (19) are attached directly to the panel (3') at opposing sides of its face with the aperture (13) located therebetween, such that the body (11) may be inserted in use. In embodiments where the protrusions (15), catch (5) and mechanism are located directly into the face of the panel (3'), the magnets are also located on the same panel (3'). The magnets (19) are provided so as to align the toy (1) with a second toy prior to contact between the two. The magnets (19), therefore, are provided in the present invention purely as a directional force for the toy (1) when aligning the same with a second toy with which it may interact. This permits interaction of the active faces of the respective toys, allowing the predetermined condition to be met for one of them when they are brought into contact with one another. When the predetermined condition is subsequently met for one of the toys, the retaining catch of that toy is released and the toy is permitted to move from the first position to the second position. That second position, in the present example, when the predetermined condition is met for one of the toys, is for that toy to move, typically inverting, and at least partially engulfing, enclosing and/or entrapping the other toy.

A second article or toy with the same features as described above for the first toy (1) may be provided. In this embodiment, the second toy also has several protrusions (215), including one (215') which when depressed, activates its release catch, and one (215") which is substantially rigid—provided so as to depress/urge inwardly a corresponding protrusion on, for example, the first toy (1), activating that toy's release catch (5). As with the first toy (1), protrusions (215), release catch and mechanism of the second toy may also be located on a removable body, as described above. Thus, as the first (1) and second toys are moved together, the magnets of the two toys serve to align the same and aid in attracting them together. Subsequently, the rigid protrusion (215") of the second toy depresses the protrusion (15') of the first toy (1), linked to the release catch (5), which enables the predetermined condition to be met in the first toy (1), wherein the catch (5) is released to cease from retaining adjacent panel (3") in the first position. The first toy (1) subsequently moves from the first position into the second, inverted position. In this instance, the second, inverted position involves the first toy (1) at least partially engulfing, enclosing and/or entrapping the second toy.

A third article or toy may be introduced, which has the same features as the first and second toys described above. The mechanism for bringing the third toy together with either the first or second toys remains the same as described above for that between the first and second toys. However, in this instance, the protrusions (315) of the third toy are arranged such that when brought into contact with the first toy (1), it is the third toy which is activated and moves from the first to the second position, at least partially engulfing, enclosing and/or entrapping the first toy. Additionally, when the third toy is brought into contact with the second toy, it is the second toy which is activated, moving from the first to the second position, at least partially engulfing, enclosing and/or entrapping the third toy. Thus, it will be appreciated that the additional protrusions (15), which may be depressed but do not activate the release catch (5), thereby providing an element of disguise to the toy (1) as to its exact arrangement. The configurations of the protrusions (15, 15', 15") may vary between differing toys (1), or, in particular, differing bodies (11), so as to provide a "rock, paper, scissor" style of gameplay between toy articles.

Additional attachments may also be provided for the toy (1) in order to allow a user to customise the same. For example, a face (not shown) may be provided as attachable either to the toy (1) directly or to the body (11) that is subsequently attached to the toy (1). This enables a user to customise their particular toy (1) and, further, special characteristics and/or points may be associated with each face in the scenario where multiple faces are provided. Each of the toys may be customised by their respective users who can choose not only which body attaches to the toy, thereby defining the configuration of the protrusions (15) of the toy (1) and which other toys it will activate/be activated by, but also the user may choose which face is to be attached. This provides a means for additional scoring, rather than merely a "paper beats rock" etc. scenario; each face will have a certain number of points associated with it, positive or negative, and so a scoring system may be introduced for multiple users of the toys.

Referring now to FIGS. 8*a-d*, further features that may be present in the toy (1) are illustrated. In particular, there is provided a reset mechanism in the form of a string, thread or tether (25). The string (25) has a free end (27) that can be gripped and pulled by a user. The string (25) is provided and arranged to be pulled/tugged once the toy (1) has been moved to the second, inverted position, and is there to aid a user in moving it back to the original first position, against the bias of the springs (7). The string (25) is located through the toy (1) connecting at least two panels. In the example shown, the string (25) runs along the length of three panels (3", 3', 3) and the terminal half panel (33), such that when the end (27) is pulled by a user, these three panels and the end portion (33) reset back into the first position, aided back the catch (5) on panel (3') re-engaging with panel (3"). The user then subsequently needs to re-join the two side panels (3) to complete movement of the toy (1) back to the first position. While a single string (25) is shown in FIGS. 8*a-d*, it is possible that additional strings may be provided, either tethered to a common end (27) such that a single pulling action moves all, or provided such that the reset can be performed in stages. Furthermore, while the current string (25) is shown to connect the three adjacent panels (3, 3', 3") and the terminal portion (33), other variations are possible, for example, wherein the string (25) may act so as to bring together side panels (3) and, consequently, panel (3') as a result of the movement, leaving the user to complete the reset by folding the remaining panel and terminal portion (33). Other variations are also envisaged by the Applicant.

Also shown in FIGS. 8*a-d* is the provision of a number of attachable add-ons or pieces (29) that affix to the panels (3, 3', 3"). Such pieces may be provided to affix in a removable/replaceable fashion to the panels such that they are exposed when the toy (1) is in the second, inverted position, i.e., they are concealed within the interior of the toy (1) when it is in the first position. These pieces may be sculpted to appear as features or body parts of a character or animal being portrayed by the toy article (1). Consequently, the string (25) of the reset mechanism may be provided to blend in with such features, and act so as to appear as, for example, a tail portion of a character or animal being portrayed by the toy article (1).

Finally, in the embodiments shown, the toy (1) is provided as being comprised of a number of evenly sized panels (3, 3', 3"), and having one further terminal portion (33), which completes the toy (1) when in the first position. However, when the toy (1) is released into the second, inverted position and is provided to "swallow" or engulf the second toy, this can leave a small gap as the toy doing the engulfing cannot fully wrap around the second toy. In some embodiments, therefore, the toy (1) may also be provided with a further, smaller panel (35), which is hingedly attached to the portion (33), shown in FIG. 8*a* only. In the inverted position, this serves to provide a greater encapsulation of another toy. The hinged nature of that portion (35) allows it to be stored, when the toy (1) is in the first position, within the interior of the toy.

It will be appreciated that the above described toy (1) need not be restricted to a cube shape for the present invention to function as described. For example, such a mechanism may be provided for the movement of an article or toy from a first position to a second, substantially inverted position, wherein the article or toy is a pyramid, having either a three-(tetrahedron) or four-sided (pentahedron) base; octahedron; dodecahedron; icosahedron and/or the like.

The invention claimed is:

1. An article, said article being moveable between a first position and a second position and biased to the second position, said article being retained in the first position by retaining means until a predetermined condition is met, wherein when said predetermined condition is met biasing means exert a biasing force to move the article from the first position to the second position, said predetermined condition being met when at least one formation, located on at least one face of the article, is moved from a first position to a second position, thereby releasing said retaining means and permitting movement of the article from the first position to the second position, and wherein said at least one formation is one of a plurality of formations which are movable from first to second positions, by being urged inwardly of the article.

2. An article according to claim 1, wherein said at least one formation is provided to be urged substantially inwardly of the article, thereby releasing said retaining means.

3. An article according to claim 1, wherein only one of the formations, when urged inwardly of the article, is capable of release of the retaining means and the movement of at least some of the formations has no impact on the retaining means.

4. An article according to claim 1, wherein the article includes at least one formation which may be urged inwardly of the article and at least one formation provided as a substantially rigid formation, such that it cannot be urged inwardly of the article.

5. An article according to claim 1, wherein a removable body is provided associated with at least one face of the article.

6. An article according to claim 5, wherein said body is removably located within an aperture in one of the said faces of the article.

7. An article according to claim 5, wherein the removable body, when located with the article, forms at least part of the face of article in which it is located.

8. An article according to claim 1, wherein at least one magnet is provided associated with the article, said at least one magnet provided to align the article substantially with a second article.

9. An article according to claim 1, wherein the article further includes reset means, which include one or more string or thread members and/or the like, provided to connect two or more faces or panels provided on the article, wherein upon activation by a user, said reset means are provided to at least partially return the article to the first position from the second position.

10. A group of articles including at least two articles as claimed in claim 1 movable between first and second positions and biased to the second positions, said articles retained in their respective first positions by retaining means until a predetermined condition is met, wherein said predetermined condition is met for a first of said at least two articles when the articles are brought into contact or within a predefined distance, at which point said first articles moves from the first position to the second position under the influence of biasing means, characterized in that said predetermined condition is met when at least one formation, located on at least one face of said first articles, is moved from a first position to a second position, thereby releasing said retaining means and permitting movement of the first article from the first position to the second position.

11. A group of articles according to claim 10, wherein said at least one formation is arranged to be urged substantially inwardly upon contact with a corresponding formation on the second of the at least two articles, wherein said corresponding formation, located on the said second article, is provided as a substantially rigid formation, such that it cannot be urged inwardly of the article on which it is located, but is arranged to urge the first formation on the first article inwardly, such that the predetermined condition is met for the first article.

12. A group of articles according to claim 10, wherein the first formation on or associated with, a first article corresponds to a second, substantially rigid formation on or associated with, a second article, and wherein when the first formation on or associated with, the first article contacts the second substantially rigid formation on or associated with, the second article, the first formation is urged inwardly of the first article and the predetermined condition is met for the first article.

13. A group of articles according to claim 10, wherein at least one magnet is provided associated with each article, located on or associated with the same a face of the articles with which the formations are associated, and arranged to align two articles with one another.

14. A group of articles according to claim 10, wherein at least two magnets are provided on substantially opposing sides of the same face of the articles, so as to be arranged to align the first article with corresponding magnets located on the second article.

15. A group of articles according to claim 10, wherein the articles further include reset means including one or more string or thread members and/or the like, wherein said one or more string or thread members are provided to connect two or more faces or panels provided on the articles, and upon activation by a user, said reset means are provided to at least partially return an article to the first position from the second position.

16. A method of causing interaction between at least two articles, said method comprising the steps of:

providing at least two articles as claimed in claim 1 in respective first positions and moveable between said first position and respective second positions;

moving the at least two articles towards each other until a predetermined condition for either or both of the first and/or second articles is met and wherein once said predetermined condition is met in an article, biasing means exert a biasing force to move that article from the first position to the second position, characterized in that said predetermined condition is met when at least one formation, located on at least one face of that article, is moved from a first position to a second position, by a corresponding formation on the other article, thereby releasing said retaining means and permitting movement of that article from the first position to the second position.

* * * * *